US012616913B2

(12) United States Patent
Yang

(10) Patent No.: US 12,616,913 B2
(45) Date of Patent: May 5, 2026

(54) VERTICAL BUBBLE MACHINE

(71) Applicant: Shantou Wintide Intelligent Technology Co., Ltd., Shantou (CN)

(72) Inventor: Shen Yang, Shantou (CN)

(73) Assignee: Shantou Wintide Intelligent Technology Co., Ltd., Shantou (CN)

( * ) Notice: Subject to any disclaimer, the term of this patent is extended or adjusted under 35 U.S.C. 154(b) by 199 days.

(21) Appl. No.: 18/777,669

(22) Filed: Jul. 19, 2024

(65) Prior Publication Data

US 2025/0387722 A1 Dec. 25, 2025

(30) Foreign Application Priority Data

Jun. 20, 2024 (CN) ..... 202421422673.1

(51) Int. Cl.
*A63H 33/28* (2006.01)

(52) U.S. Cl.
CPC ..... *A63H 33/28* (2013.01)

(58) Field of Classification Search
CPC ..... A63H 33/28
USPC ..... 446/15, 20
See application file for complete search history.

(56) References Cited

U.S. PATENT DOCUMENTS 6,200,184 B1 * 3/2001 Rich ..... A63H 33/28 D21/402
8,636,557 B2 * 1/2014 Lo ..... A63H 33/28 446/15
9,884,262 B2 * 2/2018 Huey ..... A63H 33/28
10,702,787 B2 * 7/2020 Thai ..... A63H 33/28
10,814,243 B2 * 10/2020 Clayton ..... A63H 33/28
11,446,584 B2 * 9/2022 Yang ..... A63H 33/28
11,458,411 B1 * 10/2022 Thai ..... A63H 33/26
11,772,004 B2 * 10/2023 Ruggiero ..... A63H 33/28 446/15
12,172,098 B2 * 12/2024 Chan ..... A63H 33/28
2008/0274662 A1 * 11/2008 Lo ..... A63H 33/28 446/16
2020/0139262 A1 * 5/2020 Yang ..... A63H 33/28
2023/0001320 A1 * 1/2023 Yang ..... A63H 29/22
2024/0367071 A1 * 11/2024 Yang ..... A63H 33/28

* cited by examiner

*Primary Examiner* — Kurt Fernstrom
(74) *Attorney, Agent, or Firm* — Olive Law Group, PLLC

(57) ABSTRACT

A vertical bubble machine, includes a housing, an air blowing component, a film forming component, a film scraping component, a pumping component and a liquid storage container; a mounting cavity is arranged in the housing, the film forming component is fixed in an opening of the mounting cavity, a plurality of bubbling holes are arranged on the film forming component, a liquid outlet is arranged on the film forming component, the film scraping component is rotatably assembled above the film forming component, the film scraping component is used for picking up bubble water from the liquid outlet and then sweeping past the plurality of the bubbling holes to form bubble films; the air blowing component is arranged in the mounting cavity and is located below the film forming component, an air outlet of the air blowing component faces to the film forming component.

15 Claims, 10 Drawing Sheets

VERTICAL BUBBLE MACHINE

CROSS-REFERENCE TO RELATED APPLICATIONS

The present invention claims the benefit of Chinese Patent Application No. 202421422673.1 filed on Jun. 20, 2024, the contents of which are hereby incorporated by reference.

TECHNICAL FIELD

The present invention relates to a technical field of a toy bubble blowing machine, in particular to a vertical bubble machine.

BACKGROUND

In daily life, a bubble machine is usually used as a device to adjust the atmosphere, and can be used in places such as beach, grass, square and wedding scene to create a childlike and romantic atmosphere.

Automatic bubble blowing devices are also appearing on the market. Its principle is same as that of artificial blowing bubbles, which mainly uses air to squeeze bubble water to produce a large number of bubbles in a short time, and at the same time blows the bubbles away under the action of air flow. The existing automatic bubble blowing device adopts a fan to directly supply air to a rotating film forming component, which can form a large number of bubbles and send them out. For the existing structure with multiple film forming holes rotating out of bubbles, the rotation of the film forming component drives the film forming holes to sweep past the liquid outlets one by one for form bubble films, so as to realize the form bubble films on the film forming holes. In order to realize the rotation of the film forming component, it is necessary to process an annular external gear structure on an outer side of the film forming component, which is difficult to process.

SUMMARY

In order to overcome at least one defect of the prior art, the present invention provides a vertical bubble machine, which can realize form bubble films on the bubbling holes only by the film scraping component rotating horizontally and sweeping past the liquid outlets and the bubbling holes, and no need to process an annular external gear structure on the outer side wall of the film scraping component.

To realize the above purpose, the present invention adopts the following technical solution: a vertical bubble machine, including: a housing, an air blowing component, a film forming component, a film scraping component, a pumping component and a liquid storage container; wherein a mounting cavity is arranged in the housing, a top of the mounting cavity is provided with an opening; wherein the film forming component is fixed in the opening of the mounting cavity, the film forming component is provided with a plurality of bubbling holes distributed at intervals around the circumference, at least one liquid outlet is arranged on the film forming component, each liquid outlet is arranged between two adjacent bubbling holes; wherein the pumping component is arranged in the mounting cavity, the pumping component is used for transporting bubble water in the liquid storage container to the liquid outlet; wherein the film scraping component is rotatably assembled above the film forming component, the film scraping component is used for picking up the bubble water from the liquid outlet and then sweeping past the plurality of the bubbling holes to form bubble films; wherein the air blowing component is arranged in the mounting cavity and is located below the film forming component, an air outlet of the air blowing component faces to the film forming component.

Furthermore, an annular recovery groove is arranged on an upper surface of the film forming component, and the annular recovery groove encloses the bubbling holes, a recovery hole penetrates through a bottom surface of the annular recovery groove and is connected with the liquid storage container through a recovery hose.

Furthermore, the air blowing component includes: a motor and an impeller, a rotating shaft of the motor is provided with two ends, which are respectively a first end and a second end, the impeller is drivingly connected to the first end of the rotating shaft of the motor; the vertical bubble machine further includes a gear transmission component which is driving connected with the second end of the rotating shaft of the motor, the second end of the rotating shaft of the motor is drivingly connected with the film scraping component and the pumping component respectively through the gear transmission component.

Furthermore, the film scraping component includes a rotating part and at least one scraping rod; one end of the rotating part penetrates through a center of the film forming component to drivingly connect with the gear transmission component; and one end of the scraping rod is integrally arranged with the rotating part.

Furthermore, the pumping component is a peristaltic pump including: a pump base, a liquid introduction hose and an extrusion element; the pump base is fixed in the mounting cavity; one part of the extrusion element is located in the pump base, and other part is arranged on the gear transmission component, the gear transmission component is used for driving the extrusion element to rotate in the pump base; the liquid introduction hose is arranged in the pump base and is located at an outer side of the extrusion element, two ends of the liquid introduction hose are respectively connected with the liquid storage container and the liquid outlet.

Furthermore, the gear transmission component includes a pumping gear set, a reversing gear set and a film scraping gear set, the second end of the rotating shaft of the motor drives the extrusion element on the peristaltic pump to rotate through the pumping gear set; the reversing gear set is respectively meshed with the pumping gear set and the film scraping gear set; the film scraping gear set is connected with the film scraping component, which is used for driving the film scraping component to rotate horizontally.

Furthermore, the pumping gear set includes a worm, a first dual gear, a first spur gear and a second dual gear; the worm is meshed with a large gear of the first dual gear; the first spur gear is respectively meshed with a small gear of the first dual gear and a small gear of the second dual gear, a large gear of the second dual gear is transmission-connected to the reversing gear set, the extrusion element of the peristaltic pump is fixed on the first spur gear, the first spur gear is used for driving the extrusion element to rotate.

Furthermore, the reversing gear set includes: a transmission shaft, a reversing gear and a second spur gear; the reversing gear and the second spur gear are respectively arranged at two ends of the transmission shaft; the reversing gear is meshed with the a large gear of the second dual gear, the reversing gear set is transmission-connected to the film scraping gear set.

Furthermore, the film scraping gear set includes: a third spur gear, a third dual gear and a fourth spur gear; the third spur gear is respectively meshed with the second spur gear and a large gear of the third dual gear; a small gear of the third dual gear is meshed with the fourth spur gear, the fourth spur gear is used for driving the film scraping component to rotate horizontally.

Furthermore, the liquid storage container is detachably arranged at a bottom of the housing through a thread structure, a plurality of through holes are arranged above the thread structure on the housing.

Furthermore, a mounting frame is arranged in the mounting cavity, the mounting frame is fixed below the film forming component; the air blowing component, the pumping component and the gear transmission component are all arranged above the mounting frame.

Furthermore, the housing includes: a first housing, a second housing, a fixing ring and a bottom shell; the mounting cavity is surrounded and formed by the first housing, the second housing, the fixing ring and the bottom shell, the first housing and the second housing are arranged opposite to each other, the fixing ring is sleeved on an upper side of both the first housing and the second housing, the bottom shell is arranged on a lower side of both the first housing and the second housing; the film forming component is fixed between the first housing and the second housing.

Furthermore, a circular limiting convex edge is arranged on an outer side of the film forming component, a limiting locking groove is arranged on an inner side wall of a top of the housing; the limiting locking groove is engaged with the limiting convex edge.

Furthermore, a first limiting protrusion is arranged on an inner side wall of the fixing ring; a first clamping groove is arranged on an outer side wall of a top of the housing, the first limiting protrusion is engaged with the first clamping groove; a second limiting protrusion is arranged on an inner side wall of a bottom of the housing, a second clamping groove is arranged on an outer side wall of a top of the bottom shell, the second limiting protrusion is engaged with the second clamping groove.

Furthermore, the housing is provided with a handle.

After adopting the above technical solutions, the beneficial effects of the present invention are as follows: a vertical bubble machine, including: a housing, an air blowing component, a film forming component, a film scraping component, a pumping component and a liquid storage container; wherein a mounting cavity is arranged in the housing, a top of the mounting cavity is provided with an opening; wherein the film forming component is fixed in the opening of the mounting cavity, the film forming component is provided with a plurality of bubbling holes distributed at intervals around the circumference, at least one liquid outlet is arranged on the film forming component, each liquid outlet is arranged between two adjacent bubbling holes; wherein the film scraping component is rotatably assembled above the film forming component, the film scraping component is used for picking up the bubble water from the liquid outlet and then sweeping past the plurality of the bubbling holes to form bubble films; through fixing the film forming component in the mounting cavity, the film forming component is stationary relative to the housing. Only need the film scraping component to rotate horizontally and sweep past the liquid outlet to realize form bubble films on the plurality of the bubbling holes. No need the film forming component to rotate horizontally and drive the plurality of the bubbling holes to sweep past the liquid outlet stored with bubble water or a container stored with bubble water for form bubble films, which changes the method of form bubble films; No need to process an annular external gear structure at outer side of the film forming component to realize the horizontal rotation of the film forming component, which makes the structure of the film forming component simpler and the processing more convenient.

Furthermore, an annular recovery groove is arranged on an upper surface of the film forming component, and the annular recovery groove encloses the bubbling holes. A recovery hole penetrates through a bottom surface of the annular recovery groove and is connected with the liquid storage container through the recovery hose. The bubble water overflowing from the liquid outlet is capable of flowing into the annular recovery groove, pass through the recovery hole and the recovery hose, and then enter into the liquid storage container to realize the recovery of bubble water. At the same time, it can avoid the bubble water overflowing to an outer side of the housing or into the mounting cavity, dirty the housing, and even wet the power supply to cause short circuit, which improves the service life and safety of the product.

BRIEF DESCRIPTION OF DRAWINGS

To better illustrate the technical solutions of the embodiments of the present invention or the technical solutions of the prior art, a brief introduction of the figures that need to be used in the embodiments or the description of the prior art will be given below. Obviously, the figures in the following description are only some embodiments of the present invention, for those of ordinary skilled in the art, other figures can also be obtained based on these figures without inventive efforts.

NOTE OF THE REFERENCE SIGNS

Figure 1:
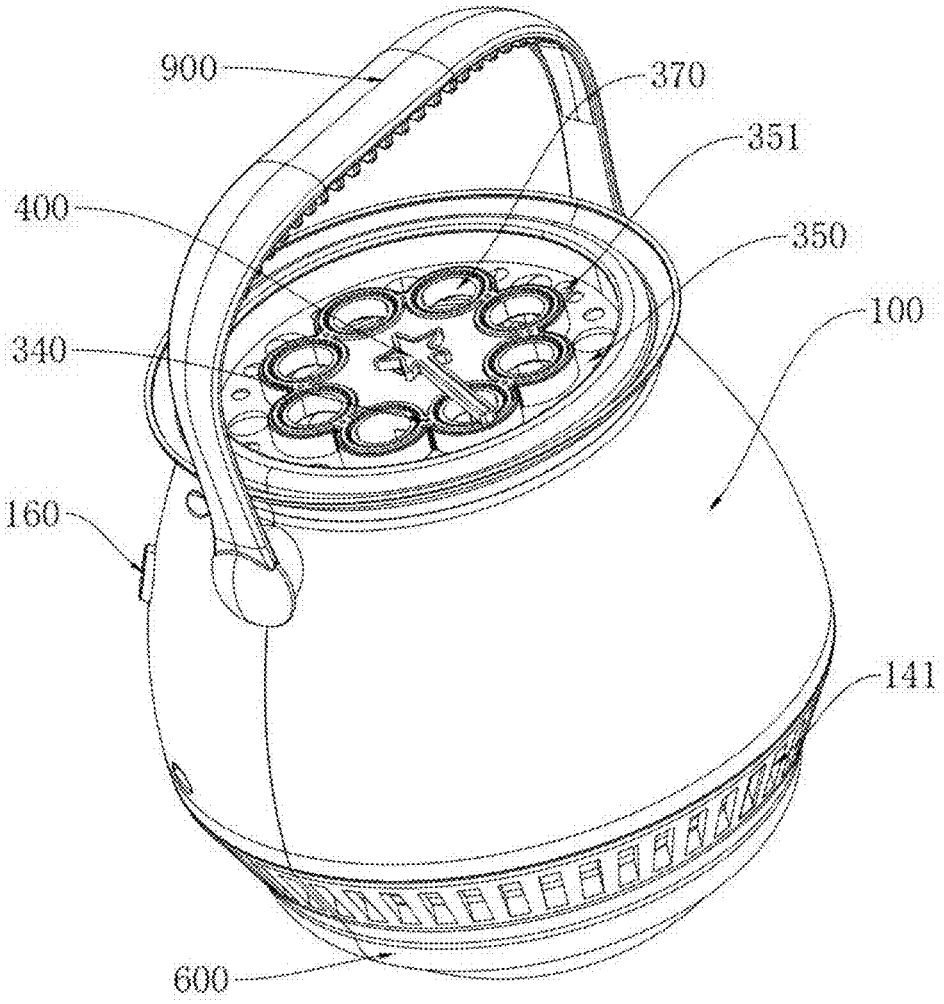
FIG. 1 is a schematic diagram of the structure of the vertical bubble machine of the present invention.
Figure 2:
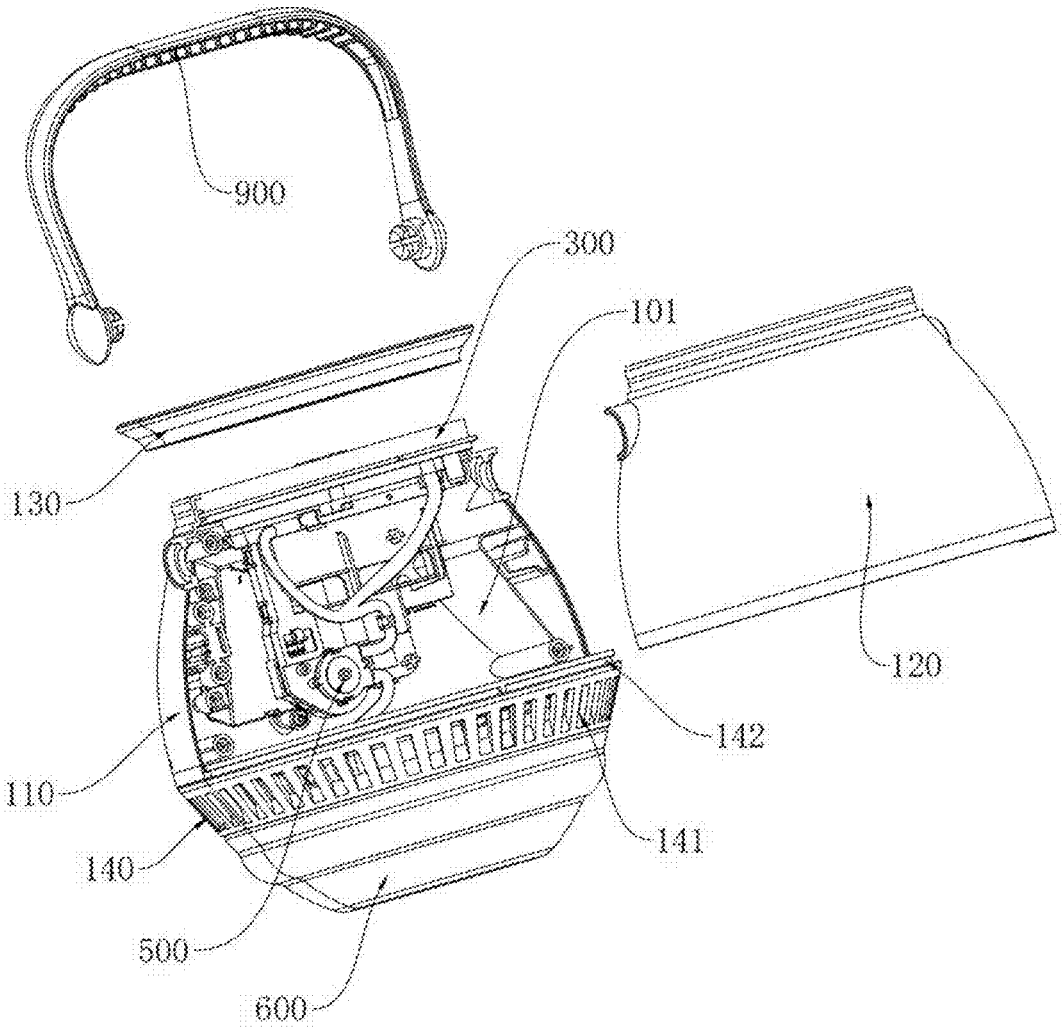
FIG. 2 is a schematic diagram of the structure of the vertical bubble machine with the housing opened.
Figure 3:
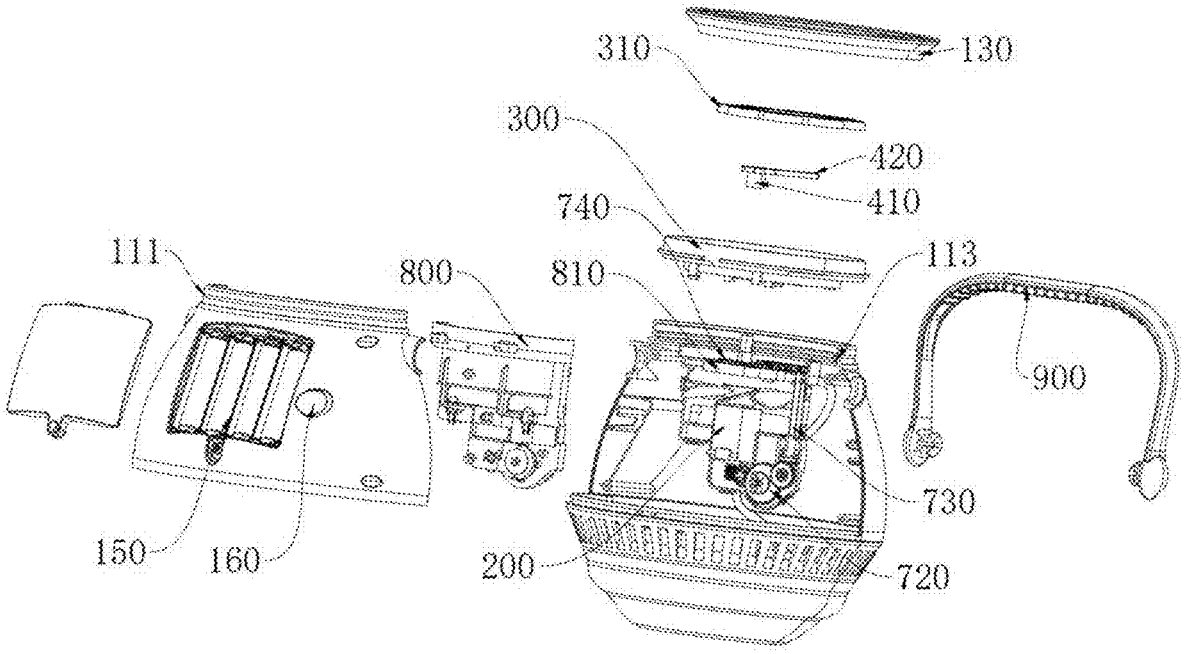
FIG. 3 is an exploded schematic diagram of the vertical bubble machine with the housing opened.
Figure 4:
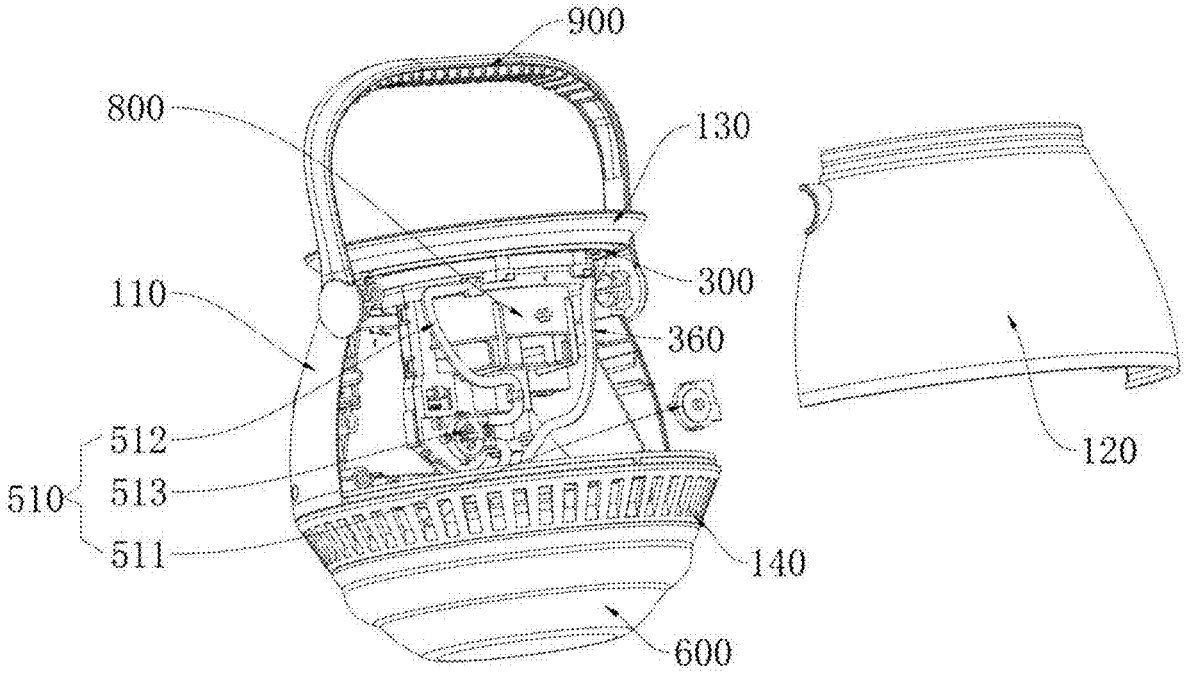
FIG. 4 is a schematic diagram of the structure of the vertical bubble machine with the second housing opened.

100—housing; 101—mounting cavity; 110—first housing; 120—second housing; 111—first clamping groove; 112—second limiting protrusion; 113—limiting locking groove; 130—fixing ring; 131—first limiting protrusion; 140—bottom shell; 141—air inlet; 142—second clamping groove; 150—power box; 160—ON/OFF switch; 200—air blowing component; 210—motor; 211—first end; 212—second end; 220— impeller; 300—film forming component; 310—film forming ring; 311—scraping protrusion; 320—connecting part; 330—limiting convex edge; 340—liquid outlet; 350—annular recovery groove; 351—recovery hole; 360—recovery hose; 370. bubbling hole; 400. film scraping component; 410. rotating part; 420. scraping rod; 500. pumping component; 510. peristaltic pump; 511. pump base; 512. liquid introduction hose; 513. extrusion element; 600. liquid storage container; 700. gear transmission component; 710. worm; 711. first dual gear; 712. first spur gear; 713. second dual gear; 720. pumping gear set; 714. transmission shaft; 715. reversing gear; 716. second spur gear; 730. reversing gear set; 717. third spur gear; 718. third dual gear; 719. fourth spur gear; 740. film scraping gear set; 800. mounting frame; 810. fixed shell; 900. handle.

DESCRIPTION OF EMBODIMENTS

Below is a further detailed description of the present invention based on the figures.

This embodiment only shows an explanation of the present invention and it is not a limitation to the present invention. The skilled in the art can make modifications to this embodiment as needed without making any creative contributions after reading this specification, which are always protected by the patent law as long as they are within the scope of the claims of the present invention.

It should be noted that when an element is called as being "fixed to" or "arranged on" another element, it can be directly on the other element or indirectly on the other element. When an element is called as being "connected to" another element, it can be directly connected to the other element or indirectly connected to the other element.

It should be understood that the terms "length", "width", "upper", "lower", "front", "rear", "left", "right", "vertical", "horizontal", "top", "bottom", "inside" and "outside" which indicates the orientations or positional relationships are based on the orientations or positional relationships shown in the figures. They are only for facilitating describing the present invention and simplifying the description, rather than indicating or implying that the device or component must have a specific orientation, construct and operate in a specific orientation, therefore, it can not be understood as a limitation of the present invention.

In addition, the terms "first" and "second" are used for descriptive purposes only and cannot be understood as indicating or implying relative importance or implicitly indicating the quantity of indicated technical features. Therefore, a feature defined as "first" and "second" may explicitly or implicitly include one or more of these features. In the description of the present invention, "a plurality of" means two or more, unless otherwise specifically defined.

This embodiment relates to a vertical bubble machine, as shown in FIGS. 1-10, including a housing 100, a air blowing component 200, a film forming component 300, a film scraping component 400, a pumping component 500 and a liquid storage container 600.

A mounting cavity 101 is arranged in the housing 100, a top pf the mounting cavity 101 is provided with an opening. The liquid storage container 600 is used for storing bubble water. The film forming component 300 is fixed in the opening of the mounting cavity 101, the film forming component 300 is provided with a plurality of bubbling holes 370 distributed at intervals around the circumference, at least one liquid outlet 340 is arranged on the film forming component 300, each liquid outlet 340 is located between two adjacent bubbling holes 370. The pumping component 500 is arranged in the mounting cavity 101 and is used for transporting the bubble water in the liquid storage container 600 to the liquid outlet 340. The film scraping component 400 is rotatably assembled above the film forming component 300 and is used for picking up the bubble water from the liquid outlet 340 and then sweeping past the plurality of the bubbling holes 370 to form bubble films. The air blowing component 200 is arranged in the mounting cavity 101 and is located below the film forming component 300. An air outlet of the air blowing component 200 faces to the film forming component 300. The air blowing component 200 is used for blowing toward the plurality of the bubbling holes 370 with films of the bubble water to realize the function of blowing bubbles. It should be noted that at least one air inlet 141 is arranged on the housing 100, the housing 100 is embedded with a power box 150 and an ON/OFF switch 160. The power box 150 is used for powering the bubble machine for working, and the ON/OFF switch 160 is used for controlling the start or stop working of the bubble machine.

By the means of fixing the film forming component 300 in the mounting cavity 101, the film forming component 300 is stationary relative to the housing 100. Only need the film scraping component 400 to rotate horizontally and sweep past the liquid outlet 340 and the plurality of the bubbling holes 370 for realizing the films hanging on the plurality of the bubbling holes 370. No need the film forming component 300 to rotate horizontally and drive the plurality of the bubbling holes 370 to sweep past the liquid outlet 340 stored with the bubble water or a container stored with the bubble water for forming bubble films, which changes the method of forming bubble films; No need to process an annular external gear structure at the outer side of the film forming component 300 to realize the horizontal rotation of the film forming component 300, which makes the structure of the film forming component 300 simpler, the processing more convenient and the production cost saved.

Furthermore, as shown in FIGS. 2-7, the air blowing component 200 includes: a motor 210 and an impeller 220. A rotating shaft of the motor 210 is provided with two ends, which are respectively a first end 211 and a second end 212. The impeller 220 is drivingly connected with the first end 211 of the rotating shaft of the motor 210. The vertical bubble machine further includes a gear transmission component 700 which is drivingly connected with the second end 212 of the rotating shaft of the motor 210. The second end 212 of the rotating shaft of the motor 210 is drivingly connected with the film scraping component 400 and the pumping component 500 respectively through the gear transmission component 700. Only need a motor 210 to drive the impeller 220, the pumping component 500 and the film scraping component 400 to start working, which makes the structure more compact. No need of a plurality of the motors 210 which saves the cost. In other embodiments, three motors 210 are arranged in the mounting cavity 101, wherein one motor 210 drives the film scraping component 400 to rotate horizontally, one motor 210 drives the pumping component to work, and other motor 210 drives the impeller 220 to rotate and supply air. Optionally, the power box 150, the ON/OFF switch 160 and the motor 210 are connected in series.

Specifically, the film scraping component 400 includes a rotating part 410 and at least one scraping rod 420. One end of the rotating part penetrates though a center of the film forming component 300 and is drivingly connected with the gear transmission component 700. One end of the scraping rod 420 is integrally arranged with the rotating part 410. The rotating part 410 is vertically arranged with the scraping rod 420. In one embodiment, one scraping rod 420 is arranged on the film scraping component 400. In one embodiment, at least two scraping rods 420 are arranged on the film scraping component 400, and at least two scraping boards are distributed in a circle with the rotation part 410 as the center.

Furthermore, a connecting shaft is protruded on one gear of the gear transmission component 700; the cross section of the connecting shaft is triangular or polygon; the connecting shaft extends upward from the mounting cavity 101 to the center of the film forming component 300; a bottom of the rotating part 410 is provided with a groove matching with the connecting shaft; the groove of the rotating part 410 is sleeved and connected on the connecting shaft, which realizes that the motor 210 drives the film scraping component 400 through the gear transmission component 700.

Preferably, as shown in FIG. 1 and FIGS. 6-8, in order to avoid wasting the bubble water or the bubble water overflowing into the mounting cavity 101, an annular recovery groove 350 is arranged on the upper surface of the film forming component 300, and is located at an outer side of the plurality of the bubbling holes 370. A recovery hole 351 penetrates through a bottom surface of the annular recovery groove 350 and is connected with the liquid storage container 600 through the recovery hose 350. The bubble water overflowing from the liquid outlet 340 flows into the annular recovery groove 350, passes though the recovery hole 351 and the recovery hose 360, and then enters into the liquid storage container 600, which realizes the recycling of the bubble water and reduces the bubble water overflowing to the outer side of the housing 100 or overflowing into the mounting cavity 101.

Optionally, as shown in FIGS. 2-7, the pumping component 500 is a peristaltic pump 510 including: a pump base 511, a liquid introduction hose 512 and an extrusion element 513. The pump base 511 is fixed in the mounting cavity 101, one part of the extrusion element 513 is located in the pump base 511 and other part is arranged on the gear transmission component 700. The gear transmission component 700 drives the extrusion element 513 to rotate in the pump base 511. The liquid introduction hose 512 is arranged in the pump base 511 and is located at the outer side of the extrusion element 513. Two ends of the liquid introduction hose 512 are respectively connected with the liquid storage container 600 and the liquid outlet 340. Specifically, the extrusion element 513 can be an eccentric gear to be arranged on the pump base 511 and is capable of drivingly connecting with one gear of the gear transmission component 700. The extrusion element 513 squeezes or releases the liquid introduction hose 512 driven by the gear transmission component 700, which changes the volume of the liquid introduction hose 512 and realizes continuous absorption of the bubble water to the liquid storage hole. In some embodiments, the extrusion element 513 is an eccentric gear. In other embodiments, the extrusion element 513 consists of at least two extrusion columns and silicone sleeves, wherein the silicone sleeves are sleeved and arranged on the extrusion columns.

Optionally, as shown in FIGS. 2-7, the gear transmission component 700 includes a pumping gear set 720, a reversing gear set 730 and a film scraping gear set 740. The second end 212 of the rotating shaft of the motor 210 drives the extrusion element 513 on the peristaltic pump 510 to rotate through the pumping gear set 720; the reversing gear set 730 is respectively meshed with the pumping gear set 720 and the film scraping gear set 740. The film scraping gear set 740 is connected with the film scraping component 400, which is used for driving the film scraping component 400 to rotate horizontally.

Figure 7:
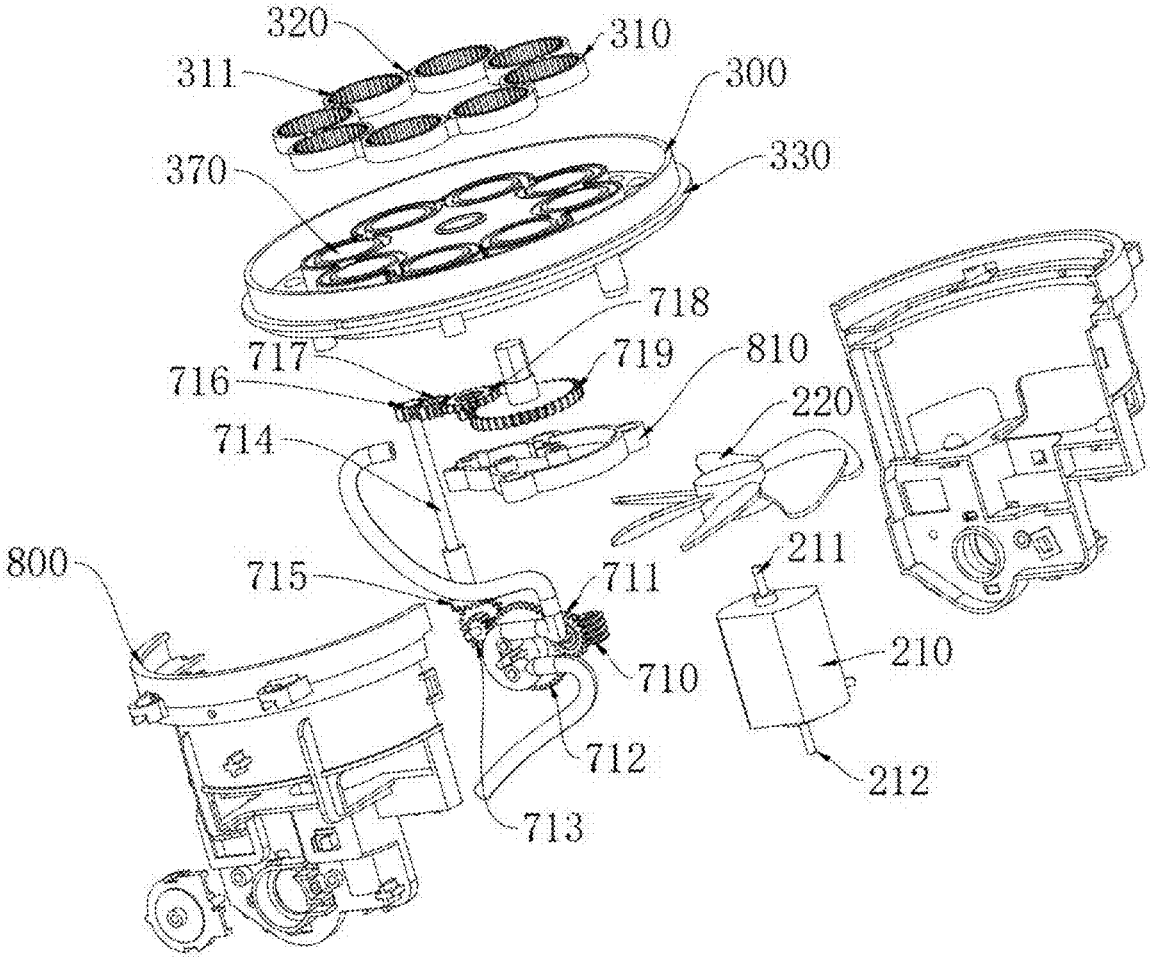
FIG. 7 is an exploded schematic diagram of the vertical bubble machine without the housing and the liquid storage container.

Specifically, as shown in FIG. 7, the pumping gear set 720 includes: a worm 710, a first dual gear 711, a first spur gear 712 and a second dual gear 713. The worm 710 is meshed with a large gear of the first dual gear 711; the first spur gear 712 is respectively meshed with a small gear of the first dual gear 711 and a small gear of the second dual gear 713. a large gear of the second dual gear 713 is transmission-connected with the reversing gear set 730. The extrusion element 513 of the peristaltic pump 510 is fixed on the first spur gear 712. The first spur gear 712 is used for driving the extrusion element 513 to rotate.

The reversing gear set 730 includes: a transmission shaft 714, a reversing gear 715 and a second spur gear 716; the reversing gear 715 and the second spur gear 716 are respectively arranged at two ends of the transmission shaft 714. The reversing gear 715 is meshed with the a large gear of the second dual gear 713. The reversing gear set 730 is transmission-connected with the film scraping gear set 740. The reversing gear 715 can be a cone gear and is not limited as a cone gear.

The film scraping gear set 740 includes: a third spur gear 717, a third dual gear 718 and a fourth spur gear 719. The third spur gear 717 is respectively meshed with the second spur gear 716 and a large gear of the third dual gear 718. a small gear of the third dual gear 178 is meshed with the fourth spur gear 719. The fourth spur gear 719 is used for driving the film scraping component 400 to rotate horizontally. Preferably, the connecting shaft is protruded and arranged on the fourth spur gear 719.

Figure 5:
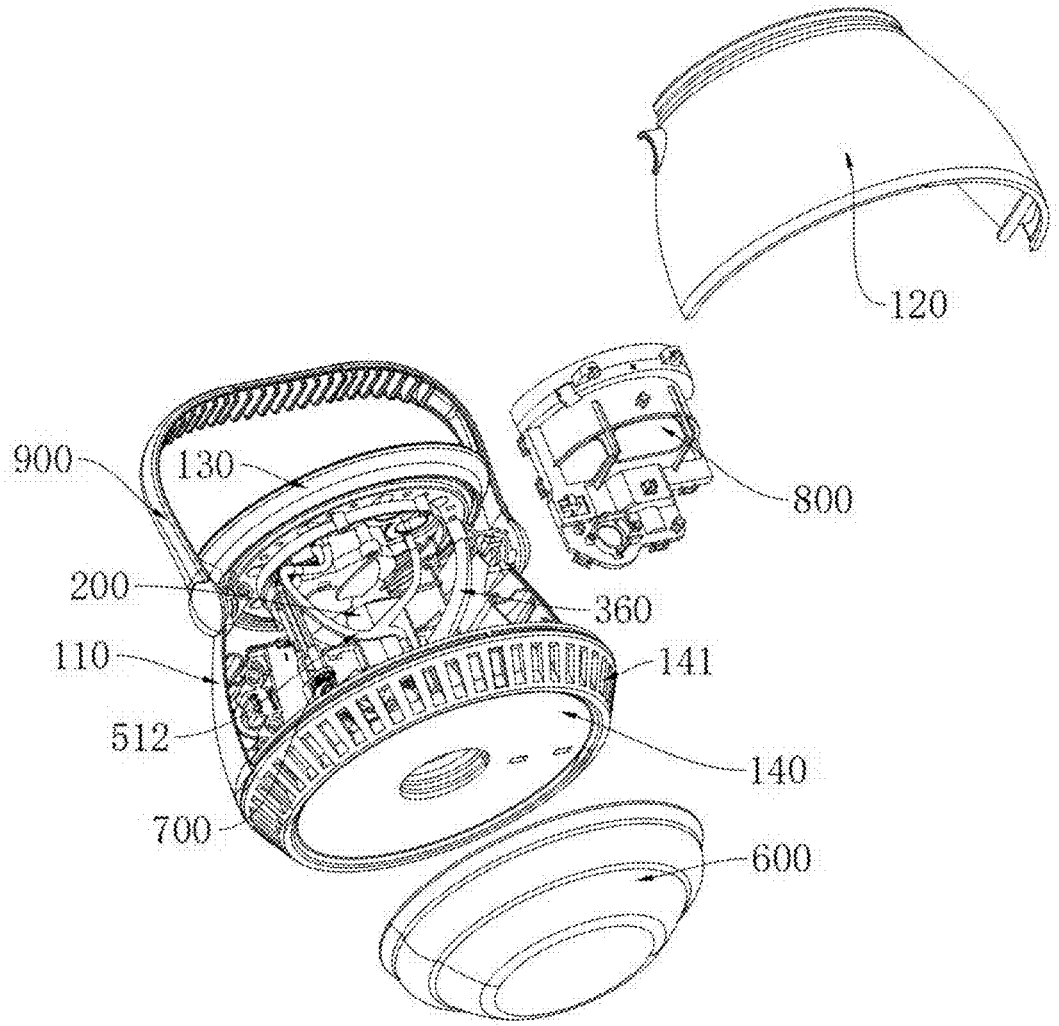
FIG. 5 is a schematic diagram of the structure of the vertical bubble machine with the second housing opened, the mounting frame and the liquid storage container opened.
Figure 6:
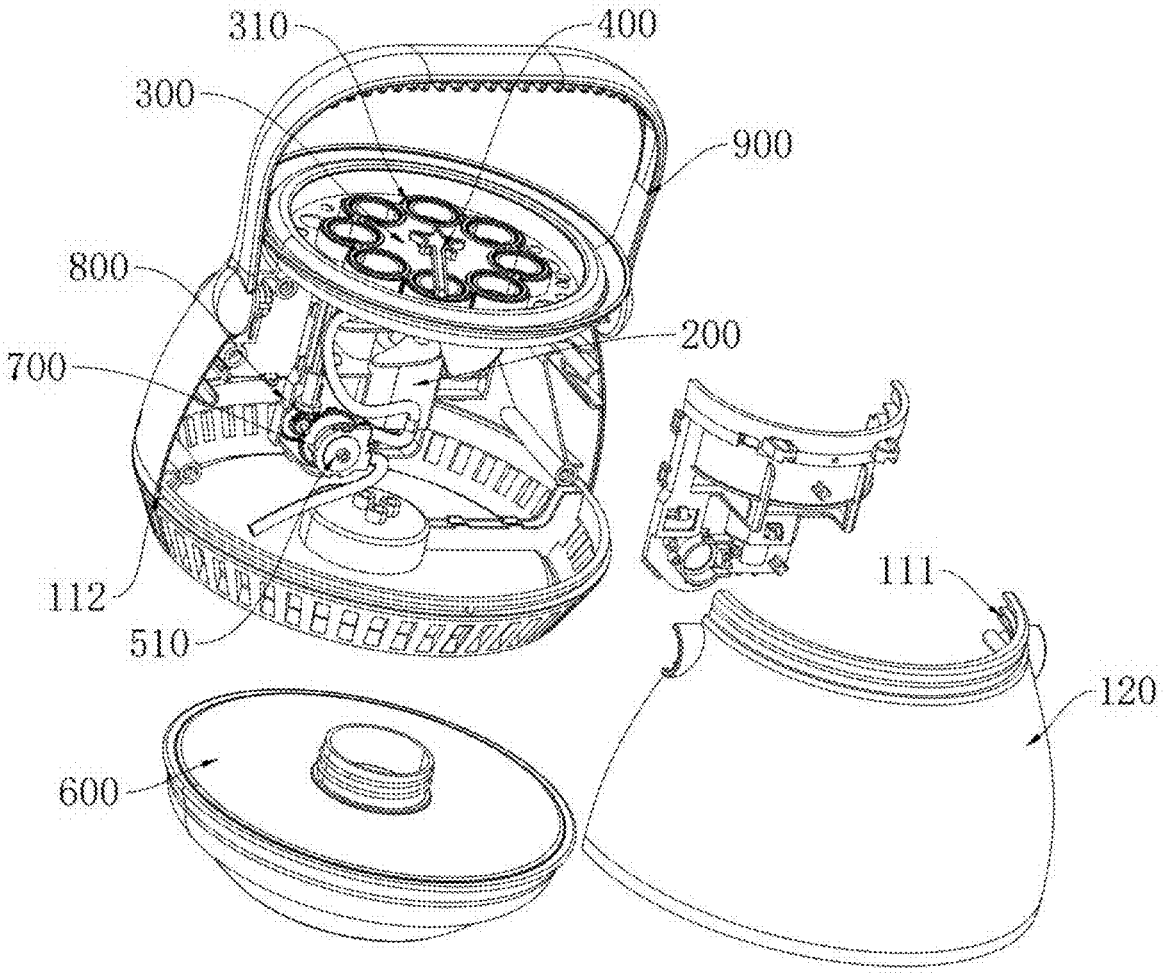
FIG. 6 is a schematic diagram of the structure of the vertical bubble machine with the second housing opened, the mounting frame and the liquid storage container opened in another direction.

Optionally, as shown in FIGS. 5-7, the liquid storage container 600 is detachably arranged at the bottom of the housing 100 through a thread structure. A bottom of the liquid storage container 600 is a flat surface. The liquid storage container 600 is capable of placing on a flat surface stably. Optionally, a plurality of through holes are arranged above the thread structure in the hosing 100. One of the plurality of the through holes is connected with the liquid outlet 340 through the liquid introduction hose 512, and at least one of the plurality of the through holes is connected with the recovery hole 351 through the recovery hose 360.

Figure 8:
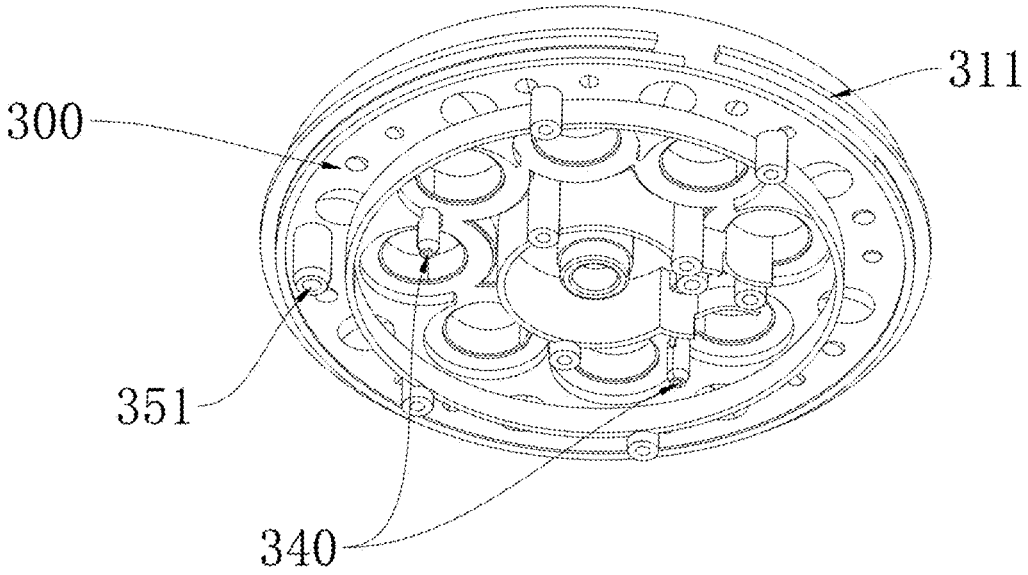
FIG. 8 is a schematic diagram of the structure of the film forming component.
Figure 9:
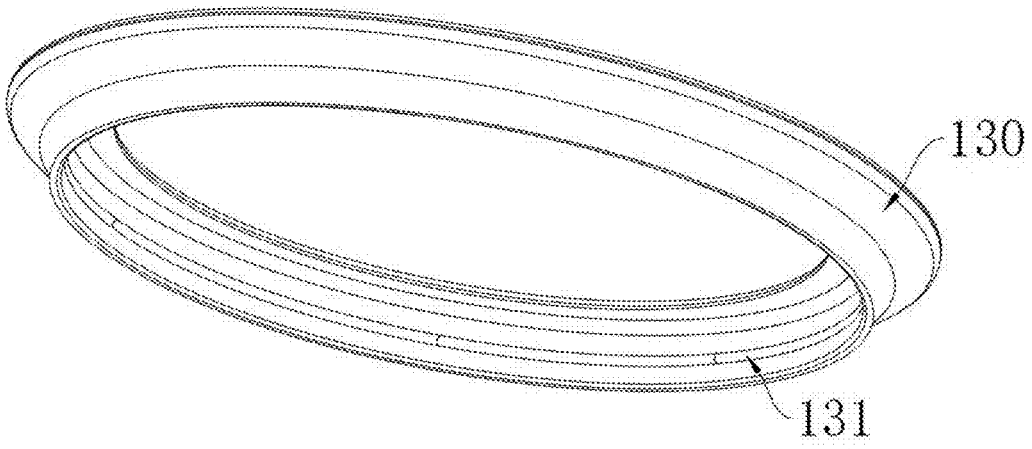
FIG. 9 is a schematic diagram of the structure of the fixing ring.
Figure 10:
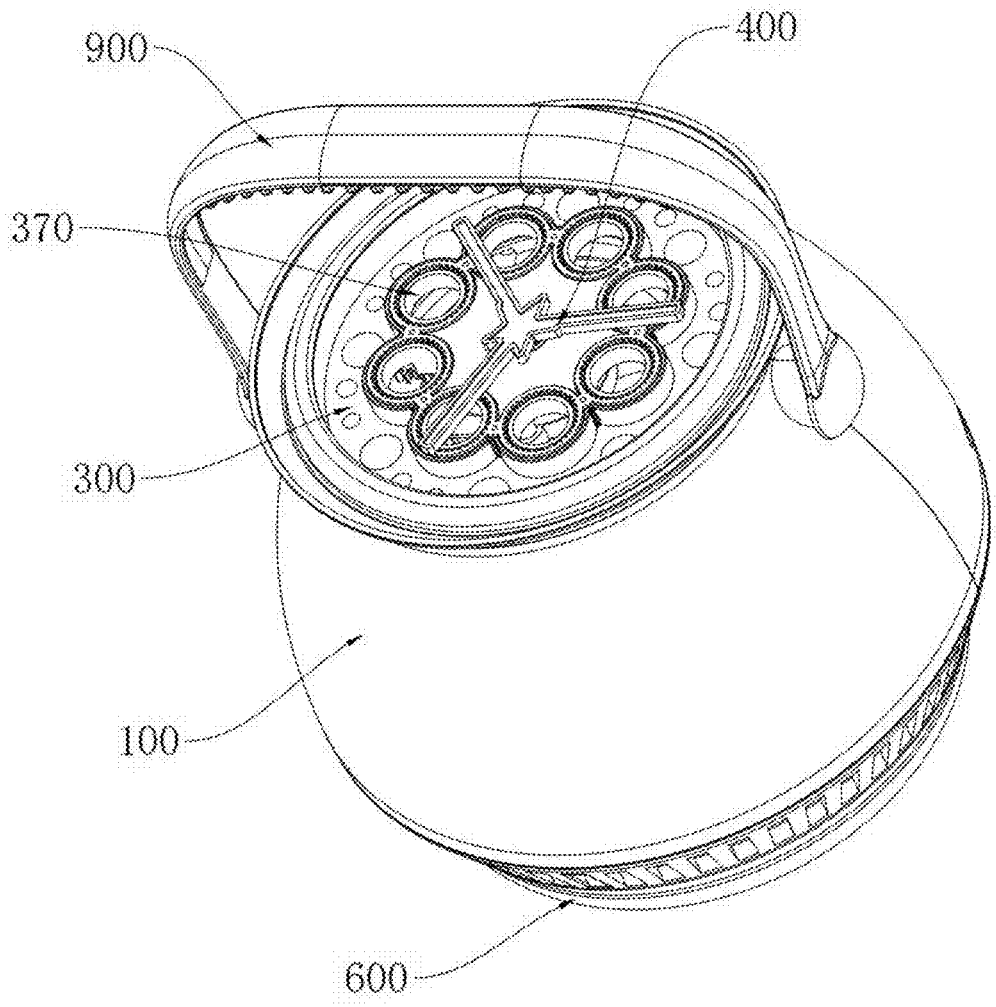
FIG. 10 is a schematic diagram of the structure of another scheme of the vertical bubble machine of the present invention.

Specifically, as shown in FIGS. 6 and 8, a plurality of first inserting columns are arranged above the thread structure in the hosing 100. The plurality of the through holes penetrate through the plurality of the first inserting columns one by one. A lower surface of the film forming component 300 is protruded downward with a plurality of second inserting columns, the liquid outlet 340 and the recovery hole 351 respectively penetrate through the plurality of the second inserting columns one by one.

Optionally, a mounting frame 800 is arranged on the mounting cavity 101 and is fixed below the film forming component 300. The mounting frame 800 is fixed below the film forming component 300 through screws. The air blowing component 200, the pumping component 500 and the gear transmission component 700 are all arranged on the mounting frame 800. Gears of the pumping gear set 720 are rotatably assembled in the mounting frame 800 through the rotating shaft. In some embodiments, there are also a fixed shell 810 is fixed below the film forming component 300. The fixed shell 810 is located in the mounting frame 800 and is fixed with the film forming component 300 through screws. The film scraping gear set 740 is rotatably assembled between the fixed shell 810 and the film forming component 300 through the rotating shaft.

Optionally, as shown in FIGS. 2-6 and FIG. 9, a film forming ring 310 is embedded on the outer side of the plurality of the bubbling holes 370 on the upper surface of the film forming component 300. A scraping protrusion 311 distributed in a circle is arranged on an inner side wall of the film forming ring 310. A connecting part 320 is connected between two adjacent film forming rings 310. The liquid outlet 340 passes through the film forming component 300 and the connecting part 320 in sequence. A lower surface of the scraping rod 420 is fitted with an upper surface of the connecting part 320. Optionally, the housing 100 includes: a first housing 110, a second housing 120, a fixing ring 130 and a bottom shell 140. The mounting cavity 101 is surrounded and formed by the first housing 110, the second housing 120, the fixing ring 130 and the bottom shell 140. The first housing 110 and the second housing 120 are arrange opposite to each other. The first housing 110 is fixed with the second housing 120 through screws. The fixing ring 130 is sleeved and arranged on the upper side of both the first housing 110 and the second housing 120. The bottom shell 140 is arranged on the lower side of both the first housing 110 and the second housing 120. The film forming component 300 is located in the fixing ring 130, and is fixed between the first housing 110 and the second housing 120.

Optionally, a first limiting protrusion 131 is arranged on an inner side wall of the fixing ring 130. A first clamping groove 111 is arranged at an outer side wall of a top of the housing 100. The first limiting protrusion 131 is engaged with the first clamping groove 111. Furthermore, a circular limiting convex edge 330 is arranged on the outer side of the film forming component 300, and a limiting locking groove 113 engaged with the limiting convex edge 330 is arranged on an inner side wall of a top of the housing 100. A second limiting protrusion 112 is arranged on an inner side wall of a bottom of the housing 100, a second clamping groove 142 is arranged on an outer side wall of a top of the bottom shell 140, the second limiting protrusion 112 is engaged with the second clamping groove 142. A plurality of air outlets 141 are arranged on the bottom shell 140.

Optionally, a handle 900 is arranged on the housing 100, the handle 900 is U-shaped. Two ends of the U-shaped handle 900 are hinged to two ends of the housing 100. The ends of the handle 900 are located between the first housing 110 and the second housing 120.

The above only aims to illustrate the technical solutions of the present invention without limitation. Any other modifications or equivalent replacements of the technical solutions of the present invention made by ordinary skilled in the art should be included in the scope of the claims of the present invention as long as they do not deviate from the technical solution spirit and scope of the present invention.

What is claimed is:

1. A vertical bubble machine, comprising: a housing, an air blowing component, a film forming component, a film scraping component, a pumping component and a liquid storage container;

wherein a mounting cavity is arranged in the housing, a top of the mounting cavity is provided with an opening;

wherein the film forming component is fixed in the opening of the mounting cavity, the film forming component is provided with a plurality of bubbling holes distributed at intervals around the circumference, at least one liquid outlet is arranged on the film forming component, the liquid outlet is arranged between two adjacent bubbling holes;

wherein the pumping component is arranged in the mounting cavity, the pumping component is used for transporting bubble water in the liquid storage container to the liquid outlet;

wherein the film scraping component is rotatably assembled above the film forming component, the film scraping component is used for picking up the bubble water from the liquid outlet and then sweeping past the plurality of the bubbling holes to form bubble films;

wherein the air blowing component is arranged in the mounting cavity and is located below the film forming component, an air outlet of the air blowing component faces to the film forming component.

2. The vertical bubble machine according to claim 1, wherein an annular recovery groove is arranged on an upper surface of the film forming component, and the annular recovery groove encloses the bubbling holes, a recovery hole penetrates through a bottom surface of the annular recovery groove and is connected with the liquid storage container through a recovery hose.

3. The vertical bubble machine according to claim 1, wherein the air blowing component comprises: a motor and an impeller, a rotating shaft of the motor is provided with two ends, which are respectively a first end and a second end, the impeller is drivingly connected to the first end of the rotating shaft of the motor; the vertical bubble machine further comprises a gear transmission component which is drivingly connected with the second end of the rotating shaft of the motor, the second end of the rotating shaft of the motor is drivingly connected with the film scraping component and the pumping component respectively through the gear transmission component.

4. The vertical bubble machine according to claim 3, wherein the film scraping component comprises a rotating part and at least one scraping rod;

one end of the rotating part penetrates through a center of the film forming component to drivingly connect with the gear transmission component; and one end of the scraping rod is integrally arranged with the rotating part.

5. The vertical bubble machine according to claim 3, wherein the pumping component is a peristaltic pump comprising a pump base, a liquid introduction hose and an extrusion element; and the pump base is fixed in the mounting cavity;

one part of the extrusion element is located in the pump base, and the other part is arranged on the gear transmission component, the gear transmission component drives the extrusion element to rotate in the pump base; and the liquid introduction hose is arranged in the pump base and is located at an outer side of the extrusion element, two ends of the liquid introduction hose are respectively connected with the liquid storage container and the liquid outlet.

6. The vertical bubble machine according to claim 5, wherein the gear transmission component comprises a pumping gear set, a reversing gear set and a film scraping gear set, the second end of the rotating shaft of the motor drives the extrusion element on the peristaltic pump to rotate through the pumping gear set; the reversing gear set is respectively meshed with the pumping gear set and the film scraping gear set; the film scraping gear set is connected with the film scraping component, which is used for driving the film scraping component to rotate horizontally.

7. The vertical bubble machine according to claim 6, wherein the pumping gear set comprises a worm, a first dual gear, a first spur gear and a second dual gear; and the worm is meshed with a large gear of the first dual gear; and the first spur gear is respectively meshed with a small gear of the first dual gear and a small gear of the second dual gear, a large gear of the second dual gear is transmission-connected to the reversing gear set, the extrusion element of the peristaltic pump is fixed on the first spur gear, the first spur gear is used for driving the extrusion element to rotate.

8. The vertical bubble machine according to claim 7, wherein the reversing gear set comprises: a transmission shaft, a reversing gear and a second spur gear; and the reversing gear and the second spur gear are respectively arranged at two ends of the transmission shaft; and the reversing gear is meshed with the large gear of the second dual gear, the reversing gear set is transmission-connected to the film scraping gear set.

9. The vertical bubble machine according to claim 8, wherein the film scraping gear set comprises: a third spur gear, a third dual gear and a fourth spur gear; and the third spur gear is respectively meshed with the second spur gear and a large gear of the third dual gear; and a small gear of the third dual gear is meshed with the fourth spur gear, the fourth spur gear is used for driving the film scraping component to rotate horizontally.

10. The vertical bubble machine according to claim 3, wherein a mounting frame is arranged in the mounting cavity, the mounting frame is fixed below the film forming component; the air blowing component, the pumping component and the gear transmission component are all arranged above the mounting frame.

11. The vertical bubble machine according to claim 1, wherein the liquid storage container is detachably arranged at a bottom of the housing through a thread structure, a plurality of through holes are arranged above the thread structure on the housing.

12. The vertical bubble machine according to claim 1, wherein the housing comprises: a first housing, a second housing, a fixing ring and a bottom shell; the mounting cavity is surrounded and formed by the first housing, the second housing, the fixing ring and the bottom shell, the first housing and the second housing are arranged opposite to each other, the fixing ring is sleeved on an upper side of both the first housing and the second housing, the bottom shell is arranged on a lower side of both the first housing and the second housing; the film forming component is fixed between the first housing and the second housing.

13. The vertical bubble machine according to claim 12, wherein a circular limiting convex edge is arranged on an outer side of the film forming component, a limiting locking groove is arranged on an inner side wall of a top of the housing; the limiting locking groove is engaged with the limiting convex edge.

14. The vertical bubble machine according to claim 12, wherein a first limiting protrusion is arranged on an inner side wall of the fixing ring; a first clamping groove is arranged on an outer side wall of the top of the housing, the first limiting protrusion is engaged with the first clamping groove; and a second limiting protrusion is arranged on an inner side wall of a bottom of the housing, a second clamping groove is arrange on an top outer side wall of the bottom shell, the second limiting protrusion is engaged with the second clamping groove.

15. The vertical bubble machine according to claim 1, wherein the housing is provided with a handle.

* * * * *